United States Patent [19]

Neyret

[11] 4,028,043

[45] June 7, 1977

[54] CIGARETTE LIGHTER WITH PRESALE TAMPER PROTECTION

[75] Inventor: Guy Neyret, Francheville, France

[73] Assignee: Genoud & Cie., Venissieux, France

[22] Filed: July 29, 1975

[21] Appl. No.: 600,072

[30] Foreign Application Priority Data

July 29, 1974 France ..... 74.27049

[52] U.S. Cl. ..... 431/144; 222/541

[51] Int. Cl.[2] ..... F23Q 25/00

[58] Field of Search ..... 431/144, 146, 150; 220/257, 265, 266, 270, 276; 222/182, 541

[56] References Cited

UNITED STATES PATENTS

| | | | |
|---|---|---|---|
| 3,162,329 | 12/1964 | Gregory | 220/265 |
| 3,263,868 | 8/1966 | Sagarin | 222/182 |
| 3,272,394 | 9/1966 | Sagarin | 222/182 |
| 3,816,058 | 6/1974 | Court | 431/276 |
| 3,851,803 | 12/1974 | Grothoff | 222/182 |
| 3,884,616 | 5/1975 | Neyret | 431/276 |
| 3,938,943 | 2/1976 | Malamoud | 431/144 |

*Primary Examiner*—Carlton R. Croyle
*Assistant Examiner*—L. J. Casaregola
*Attorney, Agent, or Firm*—Karl F. Ross; Herbert Dubno

[57] ABSTRACT

A cigarette lighter has a cylindrical fuel-containing reservoir provided on one end with a burner, a valve having a lever operable to feed fuel from the reservoir to the burner, and a striker wheel for sparking across the burner and igniting the fuel. A metal cap covers this end and has a cutout receiving the wheel and in the line with the burner. A metal tab blocks that portion of the cutout aligned with the burner and is connected to the rest of the cap by a plurality of destructible webs. This tab has a tongue extending up over the striker wheel and out above the lever so that the striker wheel cannot be actuated, nor can the lever, and the burner is covered. This protective arrangement is removable after sale to expose the lever, striker wheel, and burner and allow use of the lighter.

5 Claims, 4 Drawing Figures

CIGARETTE LIGHTER WITH PRESALE TAMPER PROTECTION

CROSS-REFERENCE TO RELATED APPLICATION

This application is related to my copending patent application Ser. No. 455,319 filed March 27, 1974, Now U.S. Pat. No. 3,920,379.

FIELD OF THE INVENTION

The present invention relates to a cigarette or cigar lighter. More particularly this invention concerns a gas-type disposable lighter.

BACKGROUND OF THE INVENTION

A gas-type disposable lighter as described in my above-identified patent application and my U.S. Pat. Nos. 63,884,616 and 3,884,618 has an elongated, usually cylindrical, reservoir adapted to receive a quantity of liquid butane fuel. One end of the reservoir is provided with a burner to which the fuel is fed by means of a valve actuated by a lever projecting laterally from the housing. A striker wheel above the lever coacts with a flint so as to spark across the burner and ignite fuel issuing therefrom when the lever is actuated. Such a lighter can be produced at extremely low cost so that when empty it can be thrown away, it not being economically practical to replenish the fuel or replace the flint.

A disposable lighter of this type is usually sold in a so-called bubble pack, carried on a piece of cardboard and covered by a bubble of transparent synthetic-resin material. This type of packaging adds somewhat to the cost of the unit which, because of its disposability, must be produced and sold as cheaply as possible. It has not been practical or safe, however, to dispense with this type of packaging as in that case there is nothing to prevent the lighter from being used prior to sale, or even to prevent its accidental actuation, thereby creating a substantial fire hazard.

OBJECTS OF THE INVENTION

It is therefore an object of the present invention to provide an improved lighter of the above-described general type.

Another object is the provision of such a lighter which need not be packaged as described above but which can be shipped safely and in a manner that prevents its use before sale.

SUMMARY OF THE INVENTION

These objects are attained according to the present invention in a lighter of the above-described type having a cap covering the burner end and with a cutout receiving the striker wheel and aligned with the burner. A metal tab blocks that portion of the cutout aligned with the burner and a destructible connection secures the tab in position at this portion of the cutout. Thus it is impossible to use the lighter with the tab in place since this element blocks the burner. Such a lighter may be shipped without a packing and, after purchase, the buyer need merely remove the tab so as to have a usable lighter.

In accordance with another feature of this invention the tab is integrally formed with the cap and is connected thereto with a plurality of thin destructible webs constituting the connection. The tab is formed with an upstanding tongue that makes it easy for the user to pry out the tab.

According to yet another feature of this invention this tab is curved semicylindridally over the striker wheel so as also to prevent rotation of this striker wheel before the tab and its tongue is removed.

In accordance with a further feature of the invention the tab has an end projecting out beyond the actuation lever of the valve for the lighter and also preventing operation of this lever so that prior to removal of the tab with its upstanding tongue it is impossible to use or actuate the lighter in any maner.

The cap according to this invention is formed of an inexpensive metal by stamping, and the piece of metal normally stamped out to form the cutout that receives the striker wheel and valve lever and exposes the burner is not stamped out and discarded but is merely shaped as described above to cover the striker wheel and lever when mounted on the end of the reservoir.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
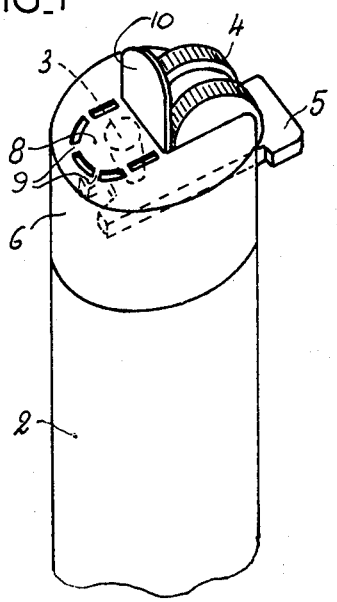
FIGS. 1–3 are perspective views of the upper ends of lighters in accordance with this invention.

As shown in FIGS. 1 through 4 a disposable cigarette lighter has a cylindrical synthetic-resin reservoir 2 provided at its upper end with a burner 3, a striker wheel 4, and a valve lever 5. When the valve lever 5 is depressed liquid butane fuel in the reservoir 2 is allowed to vaporize and exit from the burner 3. Rotation of the striker wheel 4 sends a spark from a flint underneath this wheel 4 across the burner and ignites the gaseous fuel issuing therefrom. My above-cited patents described this structure in detail.

Figure 4:
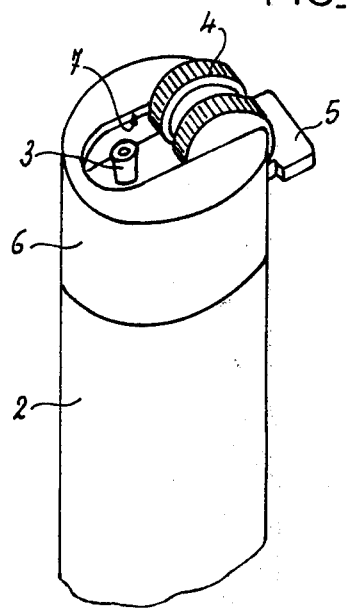
FIG. 4 is a similar view of a lighter according to this invention with the protective tab removed.

The upper end of the reservoir is provided with a cap 6 which, when the lighter is used, has a cutout 7 (FIG. 4) that exposes the burner 3 and surrounds the striker wheel 4. As is shown in FIG. 1 prior to use or sale this cutout 7 is blocked above the burner 3 by a flat tab 8 connected to the rest of the cap 6 by thin webs 9 and then for unitary with the remainder of the cap. In addition this tab 8 is formed on its side adjacent the striker wheel 4 with a short upstanding tab 10. In order to use the lighter, after purchase thereof, the tab 10 is grasped between the fingers of the user and is pulled away from the lighter. Since the cap 6 is tightly forcefit over the upper end of the reservoir 2 and since the webs 9 are relatively weak this tears out the tab 8 so as to expose the burner as shown in FIG. 4.

Figure 2:
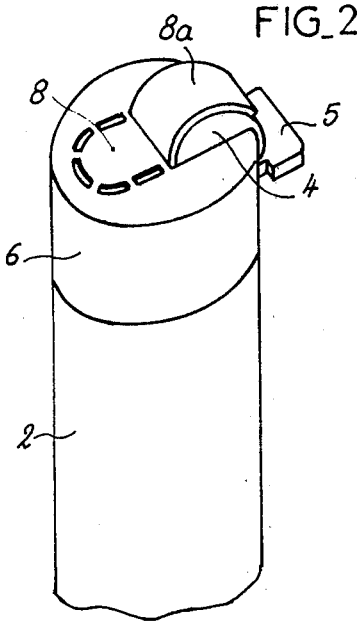

It is also possible as shown in FIG. 2 to provide the tab 8 with a part-cylindrical tongue **8*a* that extends over top of the striker wheel 4 and prevents rotation of this striker wheel until the tab 8 and tongue 8*a* have been removed. This tongue 8*a*** also enables the user to get a good grip on the removable portion so that no tools are necessary in order to set the lighter up for use.

Figure 3:
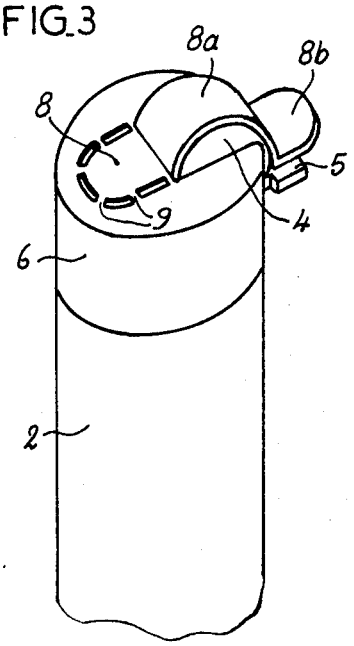

FIG. 3 shows another arrangement where the tongue **8*a* is provided with a flat outstanding portion 8*b* that overlies the lever 5 and also prevents actuation of this lever 5 until the entire arrangement 8, 8*a* and 8*b* has been removed. This protective structure is formed by stamping during manufacture of the cap 6** and adds nothing to the production costs.

It is possible to ship and sell the lighter according to the present invention without any extra packing. Thus, it is possible to reduce the already low production costs. At the same time the user is insured a virgin unused lighter at purchase so long as the protective structure described above is intact, and this purchaser may readily remove the protective arrangement so as to have a usable lighter.

I claim:

1. A lighter comprising:

a reservoir having an end and containing a supply of fuel;

a burner on said end;

valve means at said end between said burner and the interior of said reservoir actuatable for feeding said fuel to said burner;

ignition means at said end adjacent said burner and having a striker wheel rotatable for sparking at said burner and igniting fuel issuing therefrom;

an anular metal cap covering said end and having a flat wall extending transversely to said burner, said wall being formed with a window receiving said wheel and aligned with said burner;

a metal tab received within said window and covering said burner; and a destructible connection securing said tab in said portion;

said tab and said connection unitarily formed with said cap, said connection being at least one relatively thin web interconnecting said tab and said cap, said wheel projecting above said wall.

2. The lighter defined in claim 1 wherein said tab has an upstanding tongue adjacent said wheel.

3. The lighter defined in claim 2 wherein said tongue is part cylindrical and shrouds said wheel.

4. The lighter defined n claim 3 wherein said valve means includes an actuation lever projecting from said end under said wheel, said tongue having an outer end extending parallel to and covering the projecting part of said lever.

5. The lighter defined in claim 1 wherein said connection is a plurality of such webs.

* * * * *